US006663446B2

(12) United States Patent
Bernier et al.

(10) Patent No.: US 6,663,446 B2
(45) Date of Patent: Dec. 16, 2003

(54) METHOD AND SYSTEM FOR CONTROLLING THRUST OF WATERCRAFT DURING VARIOUS STEERING CONDITIONS

(75) Inventors: Fred H. Bernier, St. Hilaire, MN (US); Frank Hazard, Thief River Falls, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 0 days.

(21) Appl. No.: 10/225,603

(22) Filed: Aug. 21, 2002

(65) Prior Publication Data

US 2003/0000443 A1 Jan. 2, 2003

Related U.S. Application Data

(63) Continuation of application No. 09/456,698, filed on Dec. 9, 1999.

(51) Int. Cl.[7] ..... B63H 21/22
(52) U.S. Cl. ..... 440/1; 440/87
(58) Field of Search ..... 440/1, 84, 87; 114/144 RE

(56) References Cited

U.S. PATENT DOCUMENTS

| | | | | |
|---|---|---|---|---|
| 5,428,512 A | * | 6/1995 | Mouzas | 362/466 |
| 6,159,059 A | | 12/2000 | Bernier et al. | |
| 6,231,410 B1 | | 5/2001 | Bernier et al. | |
| 6,336,833 B1 | * | 1/2002 | Rheault et al. | 440/1 |

* cited by examiner

*Primary Examiner*—S. Joseph Morano
*Assistant Examiner*—Andrew Wright
(74) *Attorney, Agent, or Firm*—Jenner & Block, LLC

(57) ABSTRACT

A system for controlling thrust of a jet propulsion type watercraft during various steering conditions. The system comprises a thrust mechanism for providing jet propulsion thrust, a throttle regulator for regulating thrust provided by the thrust mechanism, a throttle position sensor for sensing the throttle position of the watercraft, a steering position sensor for sensing the steering position of the watercraft and a controller for determining the desired throttle position of the throttle regulator. Wherein the desired throttle position is based on the throttle position received from the throttle position sensor and the steering position received from the steering position.

20 Claims, 8 Drawing Sheets

METHOD AND SYSTEM FOR CONTROLLING THRUST OF WATERCRAFT DURING VARIOUS STEERING CONDITIONS

This application is a continuation of application Ser. No. 09/456,698 filed on Dec. 9, 1999. The present invention relates to a method and system for controlling the thrust of a watercraft during various steering conditions, and more particularly to a method and system for controlling the thrust of a watercraft of the jet propulsion type.

THE FIELD OF THE INVENTION

One type of watercraft is the jet-propelled type that is designed to be operated by a rider seated on the watercraft in a straddle-like fashion. This type of watercraft is propelled by discharging water out of a discharge nozzle located at the rear of the watercraft.

To provide steering for the watercraft, a steering nozzle is pivotably connected to the end of the discharge nozzle. The input for the pivot of the steering nozzle is provided by a steering handle pivotably mounted on the top of the watercraft. To steer the watercraft to the right, the rider turns the steering handle clockwise causing the steering nozzle to pivot counter-clockwise. The discharge of water out of the steering nozzle with the nozzle pivoted counter-clockwise causes the watercraft to yaw clockwise and turn to the right. A similar but opposite sequence is used to steer the watercraft to the left. Therefore, for a watercraft of the jet propulsion type to steer properly, a sufficient amount of thrust out of the steering nozzle is required.

The thrust of the watercraft is controlled by the rider through the use of a thumb operated throttle lever pivotably mounted on the steering handle. The throttle lever is biased toward an idle position. To increase thrust of water out of the discharge nozzle, the rider presses down on the throttle lever with his thumb. This pivots the throttle lever toward the wide-open throttle position. To decrease thrust of water out of the discharge nozzle, the rider releases the throttle lever. Since the throttle lever is biased toward the idle position, without a force countering the bias, the throttle lever pivots toward the idle position. As the throttle lever pivots toward the idle position, the thrust of water out of the discharge decreases.

While the decrease in thrust of water out of the discharge nozzle is desirable for slowing down the watercraft, the decrease in thrust of water out of the discharge nozzle also decreases the steering capability of the watercraft since the thrust provides the steering for the watercraft.

This quick decrease in steering capability is particularly problematic in situations in which an inexperienced rider attempts to avoid an obstacle directly in front of the watercraft. To properly avoid the obstacle, the rider should apply a constant pressure on the throttle lever while simultaneously turning the steering handle. However, an inexperienced rider may release the throttle lever to slow the watercraft quickly while simultaneously turning the steering handle in an attempt to maneuver around the obstacle. In such a situation, the rider may not be able to maneuver around the obstacle since steering capability has been decreased.

This decrease in steering capability is also problematic for the rider to maneuver the watercraft for docking the watercraft. Since the docking procedure usually occurs with the watercraft traveling at a low speed, the rider may release the throttle lever while attempting to dock the watercraft. However, with only idle thrust provided to steer the watercraft, steering capability may not be adequate to dock the watercraft.

SUMMARY OF THE INVENTION

The present invention is directed toward a system for controlling thrust of a jet propulsion type watercraft during various steering conditions. The system comprises a thrust mechanism for providing jet propulsion thrust, an operator-controlled throttle control mechanism, a throttle control position sensor for sensing the position of the operator-controlled throttle control mechanism, a steering mechanism for directing the jet propulsion thrust to steer the watercraft, a steering position sensor for sensing the steering position of the steering mechanism of the watercraft and a controller for determining the desired jet propulsion thrust based on the position of the operator-controlled throttle control mechanism received from the throttle control position sensor and/or the position of the steering mechanism received from the steering position sensor. The controller causes the thrust mechanism to increase thrust to a steerable thrust or inhibits the thrust from decreasing below a steerable thrust.

DESCRIPTION OF THE PREFERRED EMBODIMENT

Figure 1:
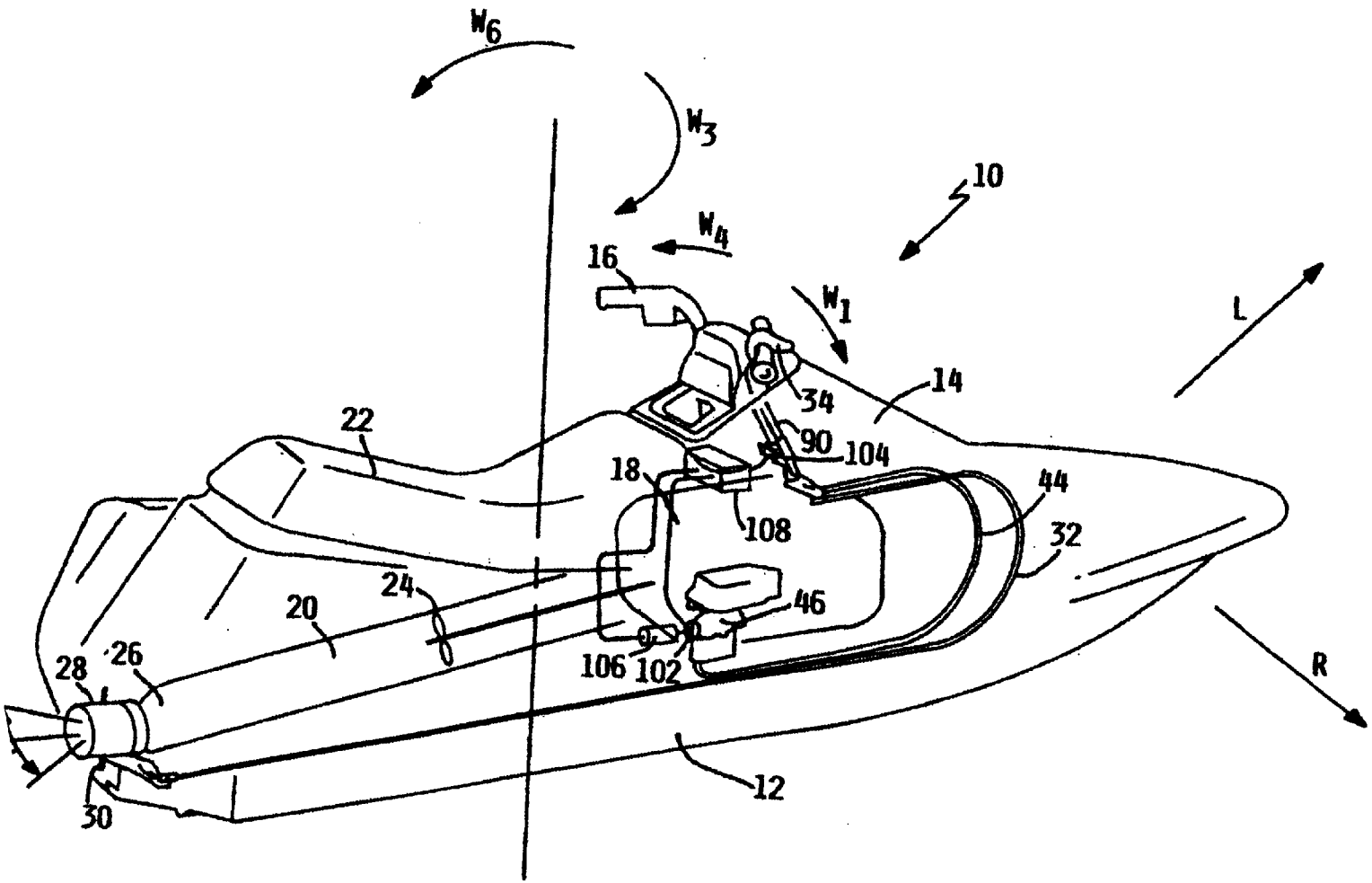
FIG. 1 is a perspective view of a watercraft in accordance to the present invention.

FIG. 1 illustrates a watercraft 10 constructed in accordance to the present invention. The watercraft comprises a hull 12 that has a bow portion 14. A steering handle 16 is pivotably mounted to the rear of the bow 14 and is part of a steering mechanism for steering the watercraft. The steering mechanism includes the steering handle 16 and a steering post 90 in which the steering handle 16 is fixed to the steering post 90 such that the steering post 90 pivots the steering handle 16.

The watercraft 10 is powered by an internal combustion engine 18 that is contained beneath the bow 14 and which drives a jet propulsion unit 20 that is disposed centrally of the hull and beneath the seat 22. The jet propulsion unit 20 includes an impeller 24 which draws water from a water inlet (not shown) and discharges the water through a discharge nozzle 26 and steering nozzle 28. The steering nozzle 28 is supported for pivotal movement about a generally vertical extending axis 30 relative to the discharge nozzle 26 for steering the watercraft 10. By pivoting the steering nozzle 28 about the vertical extending axis 30, a turning force is created on the watercraft.

The steering post 90 is mechanically linked through a steering cable 32 to the steering nozzle 28 such that a rotational movement of the steering handle 16 will cause a pivotal movement of the steering nozzle 28. For the rider to turn the watercraft 10 toward the right R, the rider would rotate the steering handle 16 clockwise $W_1$. The clockwise rotation $W_1$ of the steering handle 16 causes the steering nozzle 28 to pivot counter-clockwise $W_2$. The thrust of water out of the steering nozzle 28 with the steering nozzle 28 pivoted counter-clockwise $W_2$ causes the watercraft 10 to yaw clockwise $W_3$, thus pivoting the front of the watercraft 10 to the right R.

Similarly for the rider to turn the watercraft 10 toward the left L, the rider would rotate the steering handle 16 counter-clockwise $W_4$. The counter-clockwise $W_4$ rotation of the steering handle 16 causes the steering nozzle 28 to pivot clockwise $W_5$. The thrust of water out of the steering nozzle 28 with the steering nozzle pivoted clockwise $W_5$ causes the watercraft 10 to yaw counter-clockwise $W_6$ thus pointing the front of the watercraft 10 to the left L.

Hence, the turning capability for this type of watercraft is created from the yaw of the watercraft caused by the thrust of water out the steering nozzle with the steering nozzle pivoted toward at a certain direction. The amount of yaw is a function of both the pivot of the steering nozzle and the thrust of the water out of the steering nozzle. Therefore, even if the steering nozzle is pivoted, without sufficient thrust of water out of the steering nozzle, the watercraft is not able to yaw and turn.

Figure 2:
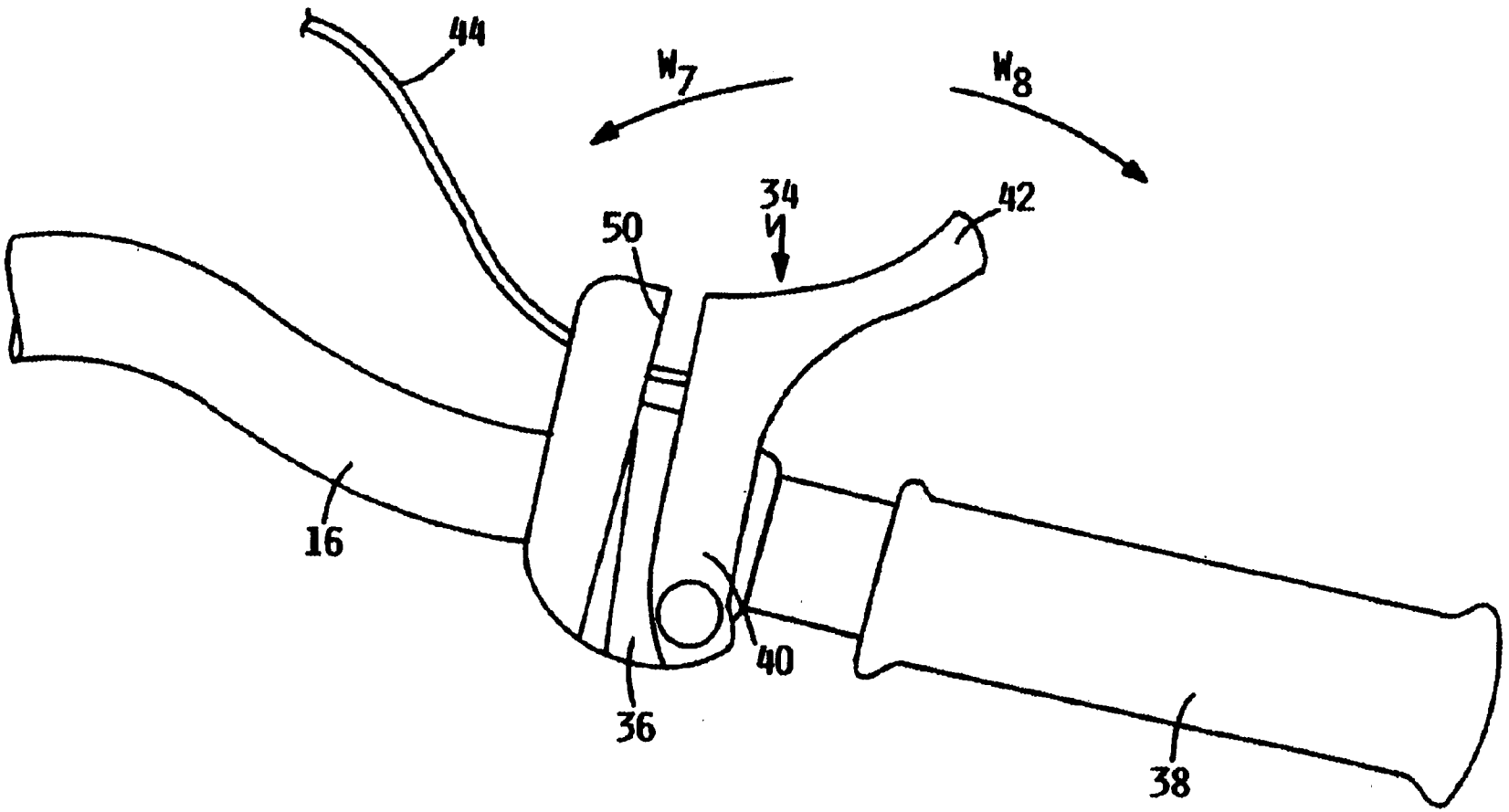
FIG. 2 is an enlarged view of the right steering handle of FIG. 1.

As illustrated in detail in FIG. 2, the rider controls the thrust of water out of the discharge nozzle through the use of a throttle lever 34 pivotably mounted to throttle lever bracket 36 attached to the circumferentially outer surface of the right portion of the steering handle 16 adjacent to a right handle grip 38. The throttle lever 34 and the throttle lever bracket 36 are mounted to the steering handle 16 with the pivot end 40 axially away from the right hand grip 38 and the lever end 42 axially toward the right hand grip 38. The right handle grip 38 and the throttle lever 34 are designed such that the rider's palm and four fingers rest on the hand grip 38 and the rider's thumb is positioned over the lever end 42 of the throttle lever 34.

Figure 3:
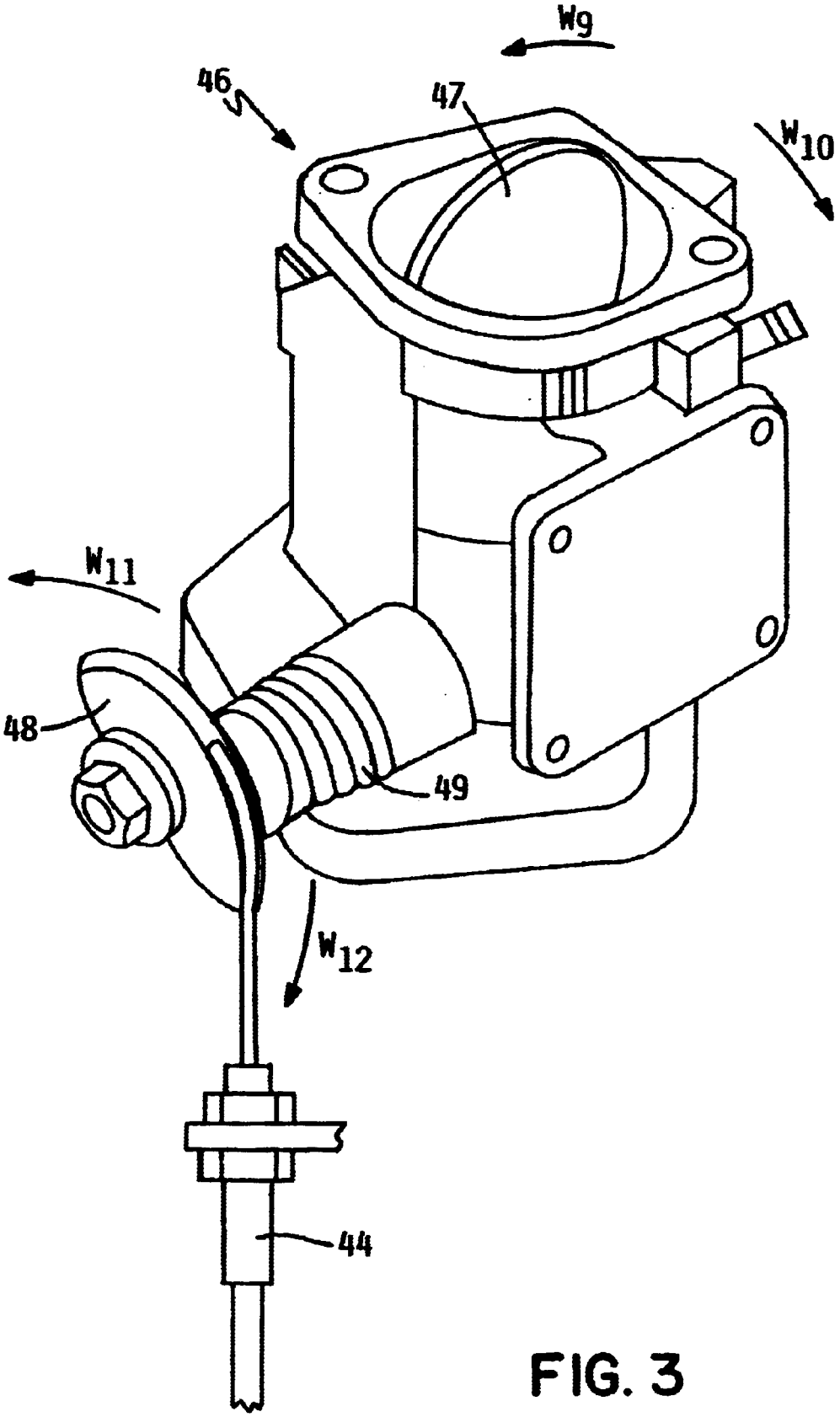
FIG. 3 is an enlarged view of the throttle regulation of FIG. 1.

As illustrated in FIG. 1, the throttle lever 34 is mechanically linked through a throttle cable 44 to a throttle regulator 46. The throttle regulator can be a carburetor for a carbureted internal combustion engine or a throttle body for a fuel injected internal combustion engine. As illustrated in detail in FIG. 3, the end of the throttle cable 44 is attached to a throttle control pulley 48 which is attached to a throttle plate 47 which regulates the amount of fuel and air provided to the combustion chamber of the internal combustion engine 18. A throttle return spring 49 is attached to the throttle control pulley 48 to bias the throttle plate 47 toward an idle position. Since the throttle lever 34 is mechanically linked to the throttle control pulley 48 of the throttle regulator, the throttle return spring 49 likewise biases the throttle lever 34 toward an idle position.

To increase the thrust of water out of the discharge nozzle 26, the rider would press down on the throttle lever 34 with his right thumb. This downward force counters the bias by the throttle return spring 49 and pivots the throttle lever 34 away from the idle position $W_7$ toward a wide open throttle position $W_8$ The rider can vary the amount of thrust out of the discharge nozzle by varying the amount of force applied on the throttle lever 34. The more force applied on the throttle lever 34, the more the throttle lever pivots from the idle position $W_7$ toward the wide open throttle position $W_8$ and pulls the throttle plate 47 of the throttle regulator toward the wide open throttle position $W_{10}$.

To reduce the thrust of water out of the discharge nozzle 26, the rider would apply a pressure on the throttle lever less than the bias caused by the throttle return spring 49. This allows the throttle lever 34 to pivot toward the idle position $W_7$ and, likewise, the throttle plate 47 of the throttle regulator toward the idle position $W_9$. The quickest way to reduce the thrust of water out of the discharge nozzle 26 is for the rider to totally release the throttle lever 34, thus allowing the throttle return spring 49 to quickly bias the throttle lever 34 and the throttle plate 47 of the throttle regulator toward the idle positions $W_7$ and $W_9$.

However, by quickly reducing the thrust of the water out of the discharge nozzle 26 by totally releasing the throttle lever 34 also quickly reduces the ability for the rider to steer the watercraft. As discussed earlier, steering of the watercraft 10 is caused by a thrust of water out of the steering nozzle 28 with the steering nozzle pivoted toward one direction, thus creating a yaw to the watercraft 10. As the amount of thrust is decreased, the amount of yaw is also decreased. This is particularly problematic when an inexperienced rider seeks to avoid hitting an obstacle directly in front of the watercraft.

To avoid the obstacle directly in front of the watercraft, the rider should turn the steering handle toward one direction while simultaneously applying pressure on the throttle lever. This procedure provides sufficient thrust out of the steering nozzle for creating an adequate yaw of the watercraft to steer clear of the obstacle. However, an inexperienced rider may panic and quickly release the throttle lever to reduce the thrust of water out of the discharge nozzle. While the velocity of the watercraft is reduced, the reduction of thrust of water out of the steering nozzle also reduces the yaw of the watercraft, therefore reducing the steering capability of the watercraft. Without adequate steering capability, the momentum of the watercraft could force the watercraft into the obstacle.

Figure 5:
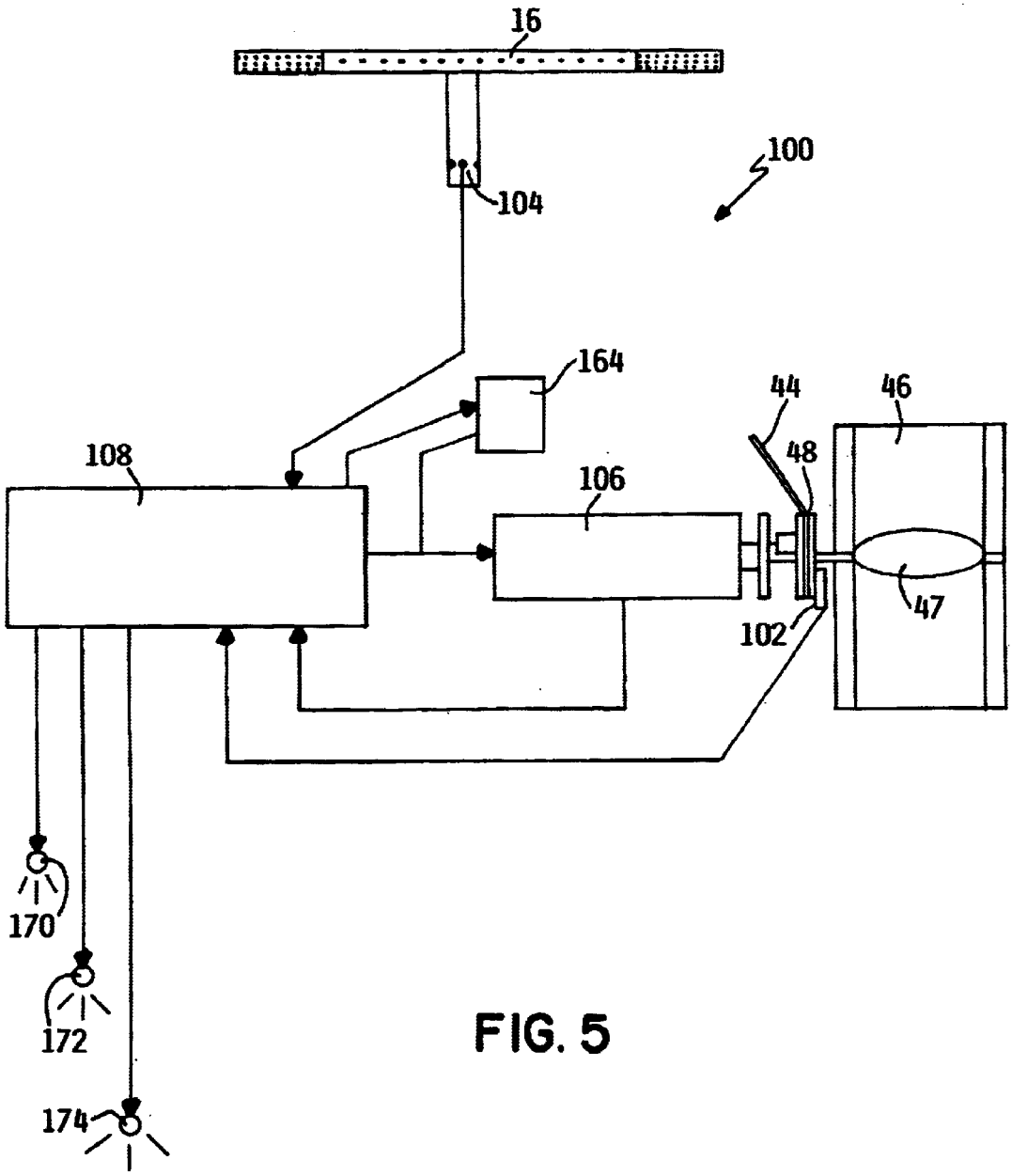
FIG. 5 is a schematic diagram of a first embodiment of the present invention.

FIG. 5 is a schematic of a first embodiment of the present invention. The present invention includes a system 100 for controlling the thrust of a watercraft during various steering conditions with inputs provided by the throttle position sensor 102 and the steering position sensor 104. The system 100 for controlling the thrust is attached to the throttle regulator 46 to provide the watercraft with adequate steering capability even if the rider releases the throttle lever 34.

The system 100 for controlling the thrust of the fifth embodiment comprises a throttle position sensor 102, a steering position sensor 104, a servomotor 106 and a microprocessor based controller 108. The throttle position sensor 102 is located at the throttle regulator 46 at either the throttle control pulley 48 or the throttle plate 47. The throttle position sensor 102 is electrically connected to the controller 108 and sends a signal to the controller 108 providing the throttle position. While the preferred embodiment illustrates the throttle position sensor 102 located at the throttle regulator 46, the throttle position sensor 102 can be located anywhere from the throttle lever 34 to the throttle regulator 46.

Figure 4:
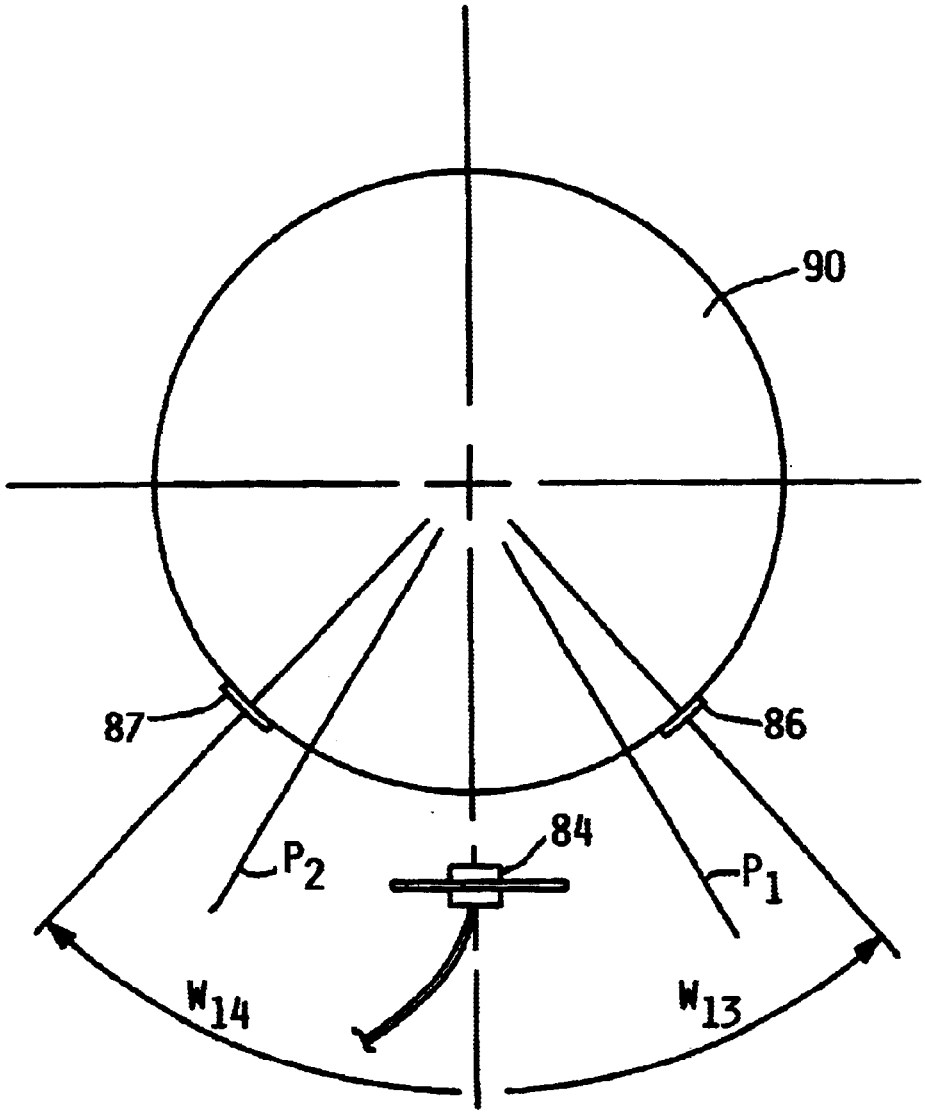
FIG. 4 is a top plan view of the steering post and proximity switch of FIG. 1.

As illustrated in FIG. 4, the steering position sensor 104 comprises a proximity switch 84 and a proximity switch triggering mechanism. The proximity switch 84 is mounted on a bracket located near the steering post 90 of the watercraft. Two magnets 86 and 87 acting as proximity-triggering mechanisms are mounted on the steering post 90. The magnets 86 and 87 are mounted on the steering post 90 such that the proximity switch 84 is located at the circumferential center of the two magnets 86 and 87 when the position of the steering post 90 causes the watercraft to travel in a straight direction. In other words, when the watercraft is traveling in a straight direction, the angle $W_{13}$ between the proximity switch 84 with one of the magnets 86 is approximately equal to the angle $W_{14}$ between the proximity switch 84 with the other magnet 87. Once the proximity switch 84 is at a given trigger angular position $P_1$ or $P_2$, the proximity switch 84 is sufficiently close to one of the magnets 86 and 87 to send a signal to the controller.

Thus, after the controller 108 receives inputs from the throttle sensor 102 that the throttle is sufficiently closed as to be unable to provide adequate steering thrust, and from the steering sensor 104 that the steering handle 16 has been sufficiently turned, the controller 108 sends a series of signals to the servomotor 106 in accordance with programmed throttle positions during a given time sequence. The servomotor 106 turns the throttle pulley 48 toward the wide open throttle position $W_{12}$ and opens the throttle plate 47 toward the wide open throttle position $W_{10}$ in accordance to the programmed throttle position during the given time sequence.

Figure 6:
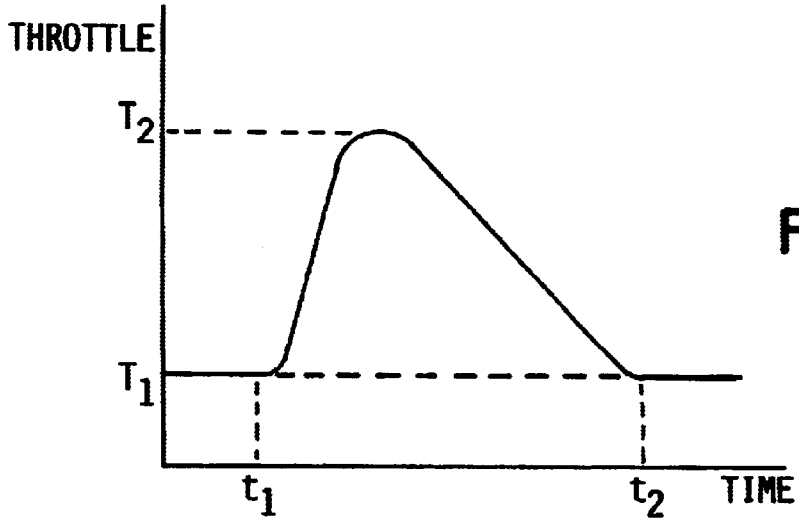
FIG. 6 is a diagram showing programmed throttle positions during a given time sequence in accordance with the first embodiment in which the throttle increases quickly to a throttle above idle throttle.
Figure 7:
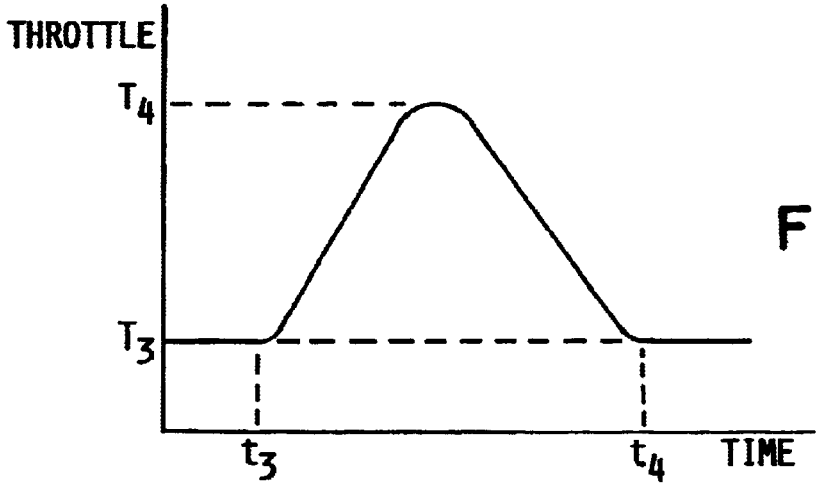
FIG. 7 is a diagram showing programmed throttle positions during a given time sequence in which the throttle increases quickly to a throttle above idle throttle.

The programmed throttle positions during the given time sequence vary between watercrafts having different hull 12 and steering nozzle 28 designs. The programmed throttle positions during a given time sequence also vary between watercrafts having different desired performance outcomes. FIGS. 6 and 7 are exemplars of such programmed throttle positions during a given time sequence. FIG. 6 illustrates that upon the throttle released and the steering handle sufficiently turned at time $t_1$, the throttle increases quickly to a throttle $T_2$ above idle throttle $T_1$ and then decreasing slowly to the idle throttle $T_1$. The programmed throttle positions during a given time sequence ($t_2$–$t_1$), as illustrated in FIG. 6, are ideal for a watercraft needing quick response such as performance oriented watercraft. This is also ideal for a watercraft less responsive to throttle, such as having a shallow hull, a long hull or a low pressured steering nozzle design.

FIG. 7 illustrates that upon the throttle released and the steering handle sufficiently turned at time $t_3$, the throttle increases slowly to a throttle $T_4$ above idle throttle $T_3$ and then decreasing slowly to the idle throttle $T_3$. The programmed throttle positions during a given time sequence ($t_4$–$t_3$), as illustrated in FIG. 7, are ideal for a watercraft used for riders wanting a smooth and gradual thrust response. This is also ideal for a watercraft very responsive to throttle input such as having a deep hull, a short hull or a high-pressure steering nozzle design.

Figure 8:
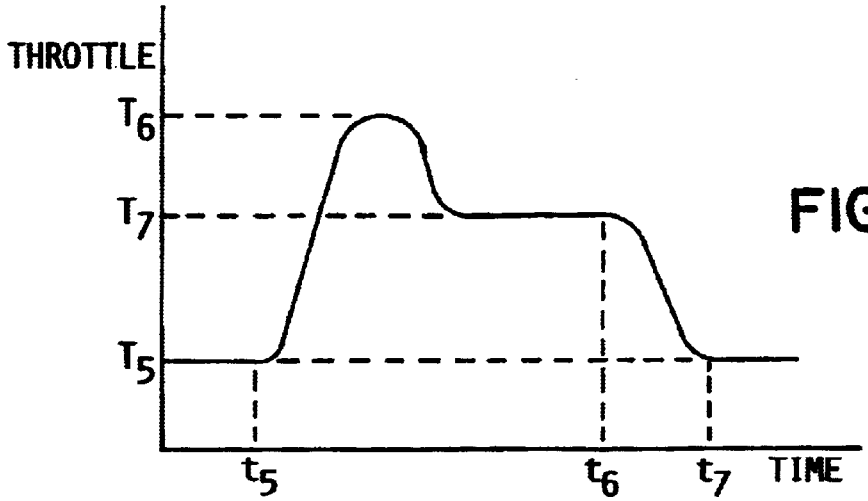
FIG. 8 is a diagram showing throttle positions remaining at a throttle above throttle until the steering handle has been turned sufficiently toward the straight-ahead position.

As illustrated in FIG. 8, the controller 108 can also be programmed to send a signal to the servomotor 106 upon the throttle released and the steering handle sufficiently turned at time $t_5$ to increase throttle to a first throttle $T_6$ above idle throttle $T_5$ and the decrease to a lower throttle $T_7$ above idle throttle $T_5$. Thereafter, the throttle remains at the lower throttle $T_7$ above idle throttle $T_5$ until the steering handle 16 has been turned sufficiently toward the straight-ahead position at time $t_6$, such that the steering position no longer surpasses steering position $P_1$ or $P_2$, thereafter the throttle decreases to the idle throttle $T_5$. This program allows the watercraft to turn quickly upon the steering handle 16 first being turned and thereafter remains at a smoother turn until the steering handle 16 has been turned sufficiently toward the straight-ahead pattern.

In short, a programmed controller of the first embodiment allows for variable throttle over a given time period upon certain required inputs sent by the throttle position sensor 102 and the steering position sensor 104.

Figure 9:
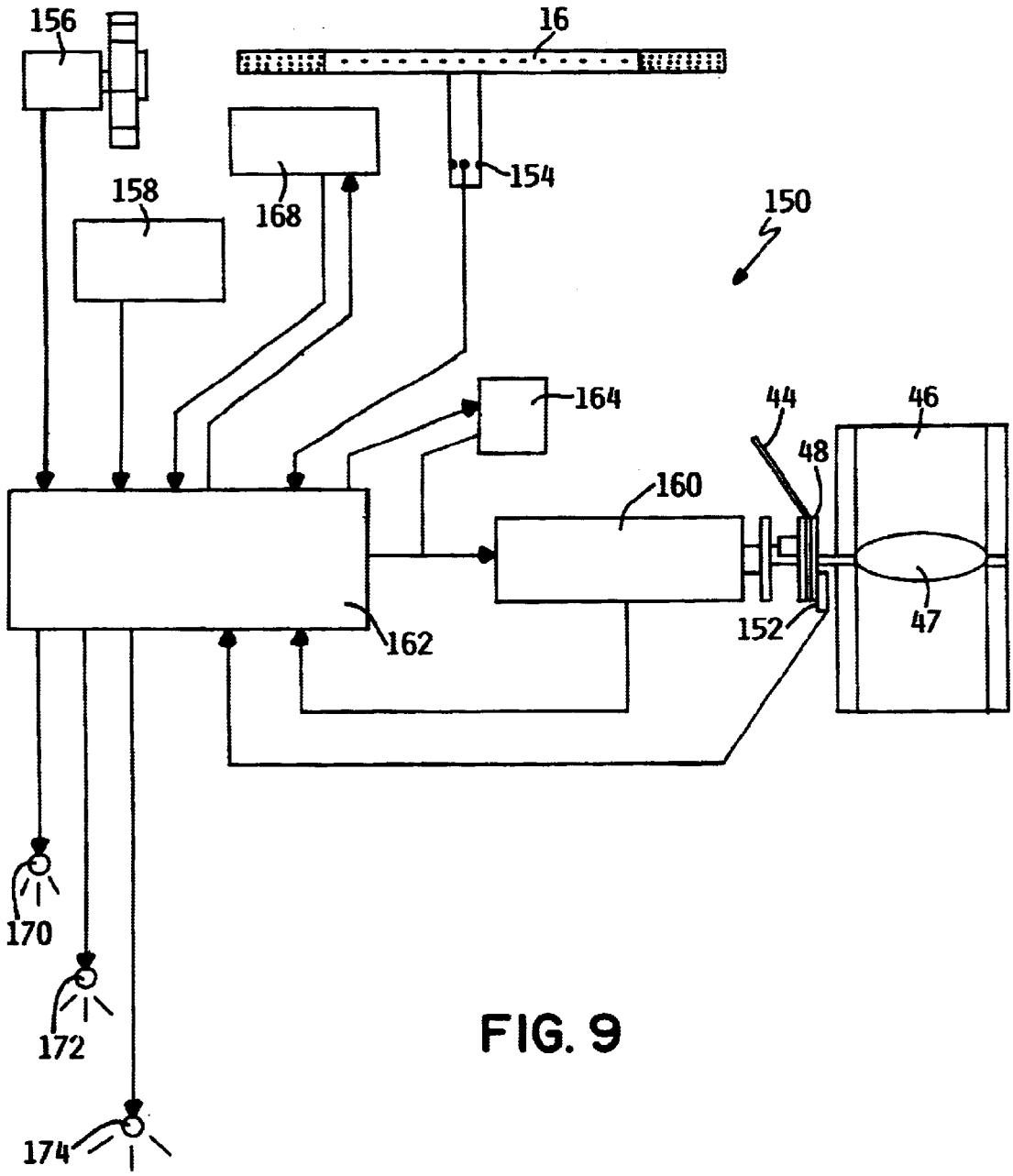
FIG. 9 is a schematic diagram of a second embodiment of the present invention.

FIG. 9 is a schematic of a second embodiment of the present invention. The present invention includes a system 150 for controlling the thrust of a watercraft during various steering conditions with inputs provided by the throttle position sensor 152, the steering position sensor 154, the hull speed sensor 156 and the engine speed sensor 158. The system for controlling the thrust is attached to the throttle regulator 46 to provide the watercraft with adequate steering capability even if the rider releases the throttle lever 34.

The system 150 for controlling the thrust of the second embodiment comprises a throttle position sensor 152, a steering position sensor 154, a hull speed sensor 156, an engine speed sensor 158, a servomotor 160 and a microprocessor-based controller 162. The throttle position sensor 152 is located at the throttle regulator 46 at either the throttle control pulley 48 or the throttle plate 47. The throttle position sensor 152 is electrically connected to the controller 162 and sends a signal to the controller 162 providing the throttle position. While the preferred embodiment illustrates the throttle position sensor 152 located at the throttle regulator 46, the throttle position sensor 152 can be located anywhere from the throttle lever 34 to the throttle regulator 46.

As illustrated in FIG. 4, the steering position sensor 152 comprises a proximity switch 84 and a proximity switch triggering mechanism. The proximity switch 84 is mounted on a bracket located near the steering post 90 of the watercraft. Two magnets 86 and 87 acting as proximity-triggering mechanisms are mounted on the steering post 90. The magnets 86 and 87 are mounted on the steering post 90 such that the proximity switch 84 is located at the circumferential center of the two magnets 86 and 87 when the position of the steering post 90 causes the watercraft to travel in a straight direction. In other words, when the watercraft is traveling in a straight direction the angle $W_{13}$ between the proximity switch 84 with one of the magnets 86 is approximately equal to the angle $W_{14}$ between the proximity switch 84 with the other magnet 87. Once the proximity switch 84 is at a given trigger angular position $P_1$ or $P_2$, the proximity switch 84 is sufficiently close to one of the magnets 86 and 87 to send a signal to the controller that the steering handle is sufficiently turned.

The hull speed sensor 156 can be a paddle wheel or a pitot tube. A paddle wheel is preferred since greater accuracy can be obtained by a paddle wheel. The hull speed sensor 156 can be located anywhere along the submerged portion of the hull 12. The hull speed sensor 156 sends a signal to the controller 162 providing the speed of the hull relative to the surrounding water. The engine speed sensor 158 can be the same sensor which normally sends a signal to the tachometer informing the rider of the engine speed. In addition to sending a signal to the tachometer, the engine speed sensor 158 also sends a signal to the controller providing the engine speed.

After the controller 162 receives inputs from the throttle position sensor 152 that the throttle is sufficiently closed as to be unable to provide adequate steering, and from the steering position sensor 154 that the steering handle 16 has been sufficiently turned, with input of the hull speed received from the hull speed sensor 156 and input of the engine speed received from the engine speed sensor 158, the controller 162 calculates a throttle position that the throttle regulator 46 should operate to obtain the desired water thrust out of the steering nozzle 28. Therefore, the calculated throttle position is a function of the hull speed and the engine speed. The formula for calculating the throttle position would vary from one watercraft to another. Examples of such variations between the watercraft include the length of the watercraft, the width of the watercraft, the hull depth of the watercraft and the desired performance of the watercraft.

With the programmed formula for calculating the throttle position, the controller 162 continuously calculates the throttle position using inputs from the hull speed sensor 156 and the engine speed sensor 158. The controller 162 then sends a signal to the servomotor 160 in accordance with the calculated throttle position. The servomotor 160 turns the throttle pulley 48 and opens the throttle plate 47 in accordance to the calculated throttle position. The controller 160 continuously calculates a new throttle position using inputs from the hull speed sensor 156 and the engine speed sensor 158 so long as the steering handle 16 is sufficiently turned and the throttle position is less that what is required to produce a steerable thrust. The time period between each calculation is dictated by the type of controller used. It is desirable to have small time periods between each calculation. However, a faster and more costly controller is required. Therefore, the time period between each calculation would depend on the cost effectiveness of the controller at the time the watercraft is designed.

It should be noted that while the controller 162 of the present invention calculates the throttle position based on the hull speed and the engine speed, it is not necessary that both the hull speed and the engine speed must be inputs for the controller 162 to operate. For example, the hull speed sensor 156 can be eliminated from the present invention and a constant value can be used in the formula for calculating the throttle position in place of a varying hull speed. Likewise, the engine speed sensor 158 can be eliminated from the present invention and a constant value can be used in the formula for calculating the throttle position in place of a varying engine speed.

The controllers 162 of the first and second embodiments also allow for several backup features to be designed into the throttle system. As illustrated in FIGS. 5 and 9, a back-up throttle return system 164 is located between the controller 162 and servomotor 160. The back-up throttle return system 164 senses the signal from the controller 162 to the servomotor 160. Should the controller 162 fail to send a signal to the servomotor 160, the back-up throttle return system 164 causes the servomotor 160 to actuate the throttle regulator 46 to an idle position $W_9$. Therefore, should the controller 162 malfunction, or the power source to the controller 162 fail, the back-up throttle return system 164 automatically returns the throttle regulator 46 to the idle position $W_9$ from the throttle position of the throttle regulator when the controller 162 fails to send a signal to the servomotor 160.

Another backup feature of the second embodiment is an acceleration prevention system 166. For some non-performance oriented watercrafts, acceleration during turning is undesirable since acceleration during turning may cause the rider to over-steer the watercraft. The controller 162 of the present invention, with the acceleration prevention feature 166, checks the current hull speed of the watercraft against an average of the previous hull speed of the watercraft. Should the current hull speed be greater than the average of the previous hull speed, the controller 162 causes the throttle regulator 46 to reduce the water thrust out of the steering nozzle until the current hull speed is no longer greater than the average of the previous hull speed. Should the current hull speed fail to be reduced, such that the current hull speed is no longer greater than the average of the previous hull speed after a given amount of time, the back-up throttle return system 164 is activated to return the throttle regulator 46 to idle throttle $W_9$. Should the back-up throttle return system 164 also fail to reduce the current hull speed such that the current hull speed is no longer greater than the average of the previous hull after a given amount of time, an engine kill switch 168 is activated to stop the engine 18 completely.

As further diagramed in FIGS. 5 and 9, additional features can be provided to the system for controlling the thrust of the watercraft. These additional features include a poor steering lite 170, a steer active lite 172 and a fail lite 174. Upon the controller 162 determining the steering handle 16 has been sufficiently turned and the throttle position below a position that would provide adequate steering thrust, the controller 162 sends power to the poor steering conditions lite 170 to inform the rider that the watercraft is experiencing poor steering condition. During the time period the controller 162 activates the servomotor 160, the controller 162 sends power to the steering active lite 172 to inform the rider that the system for controlling thrust has been activated. Should the back-up throttle return system 164 be activated due to the controller's failure to send a signal to the servomotor, or the watercraft continuing to accelerate during the turn after a given amount of time, the controller 164 sends power to the fail lite 174 to inform the rider that the off-throttle steering system has failed to operate properly.

Figure 10:
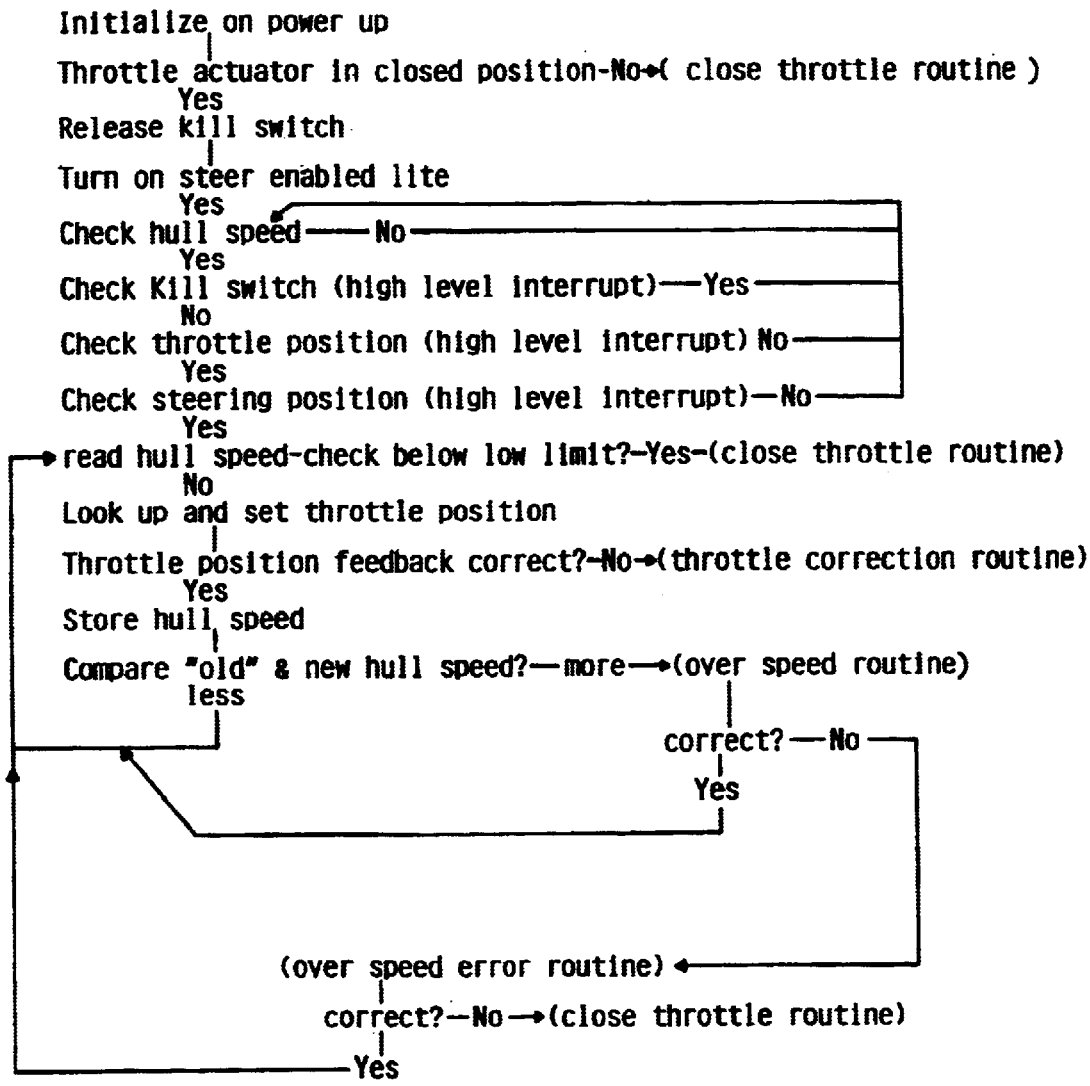
FIG. 10 is a flow diagram showing an exemplar programming for the controller in accordance with the second embodiment.

FIG. 10 is a flow diagram showing an exemplar programming for the controller 162 in accordance with the second embodiment.

Various features of the present invention have been described with reference to the embodiments shown and described. It should be understood, however, that modifications may be made without departing from the spirit and scope of the invention as represented by the following claims.

What is claimed is:

1. A method for providing steering for a watercraft, having a steering mechanism, a thrust mechanism, a manually operable throttle control mechanism, a sensor for sensing position of the manually operable throttle control mechanism and a controller for determining desired thrust from the thrust mechanism, the steps comprising inhibiting the thrust from decreasing below a steerable thrust when the manually operable throttle control mechanism is released.

2. The method for providing steering for a watercraft as claimed in claim 1 wherein said controller is a microprocessor.

3. The method for providing steering for a watercraft as claimed in claim 1 wherein the thrust is inhibited from decreasing below a steerable thrust when the steering mechanism is positioned for turning said watercraft.

4. A watercraft including a steering mechanism, a thrust mechanism, an operator-controlled throttle control mechanism, a sensor for sensing position of the operator-controlled throttle control mechanism and a controller for determining a desired thrust which is greater than the thrust normally provided by the position of the operator-controlled throttle control mechanism.

5. The watercraft as claimed in claim 4 wherein said controller is a microprocessor.

6. The watercraft as claimed in claim 4 wherein a steerable thrust is provided when said steering mechanism is positioned for turning said watercraft.

7. A system for controlling thrust of a jet propulsion type watercraft during various steering conditions, the system comprising:

a thrust mechanism for providing jet propulsion thrust;

a steering mechanism for directing the jet propulsion thrust to steer said watercraft;

a steering position sensor for sensing the position of said steering mechanism;

an operator-controlled throttle control mechanism;

a throttle control position sensor for sensing the position of said operator-controlled throttle control mechanism;

a controller for determining a desired jet propulsion thrust based on the position of said operator-controlled throttle control mechanism received from said throttle control position sensor; and wherein said controller inhibits the thrust from decreasing below a steerable thrust upon said operator-controlled throttle control mechanism positioned other than to provide a steerable thrust.

8. The system as claimed in claim 7 wherein said controller is a microprocessor.

9. The system as claimed in claim 7 further comprises a throttle regulator for regulating thrust provided by said thrust mechanism.

10. The system as claimed in claim 9 wherein said throttle regulator is a throttle body of a fuel injection system.

11. The system as claimed in claim 7 wherein said steering position sensor includes a cylindrically spaced first magnet and second magnet fixed on said steering mechanism and a proximity switch rotationally independent of said steering mechanism.

12. A system for controlling thrust of a jet propulsion type watercraft traveling above low speed, the system comprising:

a thrust mechanism for providing jet propulsion thrust;

a steering mechanism for directing the jet thrust to steer aid watercraft;

a steering position sensor for sensing the steering position of said steering mechanism;

an operator-controlled throttle control mechanism;

a throttle control position sensor for sensing the position of said operator-controlled throttle control mechanism;

a controller for determining a desired jet propulsion thrust based on the position of said of said operator-controlled throttle control mechanism received from said throttle control position sensor; and wherein said controller caused said thrust mechanism to increase thrust upon said operator-controlled throttle control mechanism positioned other than to provide a steerable thrust.

13. The system as claimed in claim 12 wherein said controller is a microprocessor.

14. The system as claimed in claim 12 further comprises a throttle regulator for regulating thrust provided by said thrust mechanism.

15. The system as claimed in claim 14 wherein said throttle regulator is a throttle body of a fuel injection system.

16. The system as claimed in claim 12 wherein said steering position sensor includes a cylindrically spaced first magnet and second magnet fixed on said steering mechanism and a proximity switch rotationally independent of said steering mechanism.

17. A method for controlling thrust of a jet propulsion type watercraft traveling above low speed, the method comprising:

sensing the position of a steering mechanism of the watercraft;

sensing the position of a manually operable throttle control mechanism;

providing a controller for determining a desired thrust based on said position of said manually operable throttle control mechanism; and increasing the thrust upon said manually operable throttle control mechanism positioned other than to provide a steerable thrust.

18. The method as claimed in claim 17 wherein said controller is a microprocessor.

19. A method for controlling thrust of a jet propulsion type watercraft during various steering conditions, the method comprising:

sensing the position of a steering mechanism of the watercraft;

sensing the position of a manually operable throttle control mechanism;

providing a controller for determining a desired thrust based on said position of said manually operable throttle control mechanism; and inhibiting the thrust from decreasing below a steerable thrust upon said manually operable throttle control mechanism positioned other than to provide a steerable thrust.

20. The method as claimed in claim 19 wherein said controller is a microprocessor.

* * * * *